US005335641A

United States Patent [19]

Schnabel

[11] Patent Number: 5,335,641

[45] Date of Patent: Aug. 9, 1994

[54] OIL FILLER FOR AN INTERNAL COMBUSTION ENGINE

[75] Inventor: Werner Schnabel, Freiberg, Fed. Rep. of Germany

[73] Assignee: Filterwerk Mann & Hummel GmbH, Ludwigsburg, Fed. Rep. of Germany

[21] Appl. No.: 46,487

[22] Filed: Apr. 13, 1993

[30] Foreign Application Priority Data

Apr. 18, 1992 [DE] Fed. Rep. of Germany ..... 4212968

[51] Int. Cl.[5] ..... F01M 13/00

[52] U.S. Cl. ..... 123/574; 123/572; 220/203; 220/209; 220/360; 220/746; 137/510

[58] Field of Search ..... 220/209, 203, 360, 374, 220/746, 747, DIG. 33, DIG 32; 123/574, 572; 137/510, 517, 907

[56] References Cited

U.S. PATENT DOCUMENTS 4,169,432 10/1979 White ..... 123/574 X
5,080,082 1/1992 Mueller et al. ..... 123/572 X
5,090,393 2/1992 Holch ..... 123/574

*Primary Examiner*—Allan N. Shoap
*Assistant Examiner*—Nova Stucker
*Attorney, Agent, or Firm*—Evenson, McKeown, Edwards & Lenahan

[57] ABSTRACT

A pressure control valve for controlling the vacuum in a crankcase housing, which valve is disposed on an oil filler opening (33) and simultaneously acts as a cap for the oil filler opening. A tube 37 through which the crankcase gases are conveyed to the air intake of the internal combustion engine is provided in the oil filler opening. The pressure control valve serves to establish a certain vacuum in the crankcase, is of compact construction, and can be replaced or checked in a simple manner.

6 Claims, 2 Drawing Sheets

OIL FILLER FOR AN INTERNAL COMBUSTION ENGINE

BACKGROUND OF THE INVENTION

The invention relates to an oil filler for an internal combustion engine. These oil fillers are usually provided in or adjacent a valve cover and comprise an oil filler opening which is closed with a cap.

It is generally known to provide pressure control valves for crankcase ventilation, for example in the vent line between the crankcase and the air intake filter or intake manifold. With these pressure control valves there is a continuous connection between the crankcase and the air intake side of the engine through which so-called blow-by gases are aspirated and returned to the combustion process. The pressure control valve assures that the vacuum in the crankcase does not fall below a certain level. A constantly prevailing light vacuum in the crankcase prevents blow-by gases from escaping into the free atmosphere. By controlling the crankcase pressure, the internal combustion engine system is assured of maximum containment so that no pollutants can pass into the free atmosphere.

A pressure control valve of this kind is usually flange-mounted to the side of the engine and is connected by appropriate connecting lines to the crankcase and intake manifold or air filter. Such valves are disclosed, for example, in publication No. VKD 7032 of Filterwerk Mann & Hummel GmbH. The pressure control valve is usually fastened to the engine body with a flange or a steel bracket.

For the sake of the appearance of the engine compartment, it is necessary to design such engine-mounted components accordingly, and provide them, for example, with covers or the like. This, however, calls for considerable effort and consequently involves additional expense.

Mueller et al, Published German Patent Application No. DE 4,017,074 discloses a pressure control valve which is arranged in a combination unit with oil filler tube and oil dip stick. This pressure control valve, however, is still connected to the intake manifold or air intake tube of the engine, so that it is difficult to inspect and/or replace the valve.

SUMMARY OF THE INVENTION

It is the object of the present invention to provide an oil filler arrangement which facilitates easy inspection and replacement of a crankcase pressure control valve.

Another object of the invention is to provide an oil filler arrangement which contributes to a better appearance of an engine with which it is used.

It is also an object of the invention to provide an oil filler arrangement which has a simple and economical construction.

These and other objects of the invention are achieved by providing an oil filler for an internal combustion engine having an air intake and a crankcase, the oil filler comprising a filler opening for motor oil and a cap for closing the opening, the cap comprising a pressure control valve having a substantially cylindrically shaped housing for venting the crankcase of the internal combustion engine, the pressure control valve being provided with a first connection through which crankcase gases from the crankcase enter the valve, and a second connection which communicates via a connecting line to the air intake of the internal combustion engine.

The important advantage of the solution in accordance with the invention is to be seen in the fact that now the pressure control valve is integrated into the cap of the oil filler and thus additionally serves as part of the cap. This has the advantage of making it readily possible to quickly check the pressure control valve and replace it if necessary. Furthermore, the additional tubular connection that was formerly needed from the motor to the pressure control valve is eliminated, since the pressure control valve now receives the blow-by gases directly from the engine. Also, the integration of the valve into the cap presents a good solution of the configuration and appearance problem.

In accordance with a further preferred embodiment of the invention, the connection for carrying the crankcase gases is arranged coaxially within the oil filler tube. The cap, which houses the pressure control valve, is placed over this connection by means, for example, of a bayonet lock, and thus creates the connection for the crankcase gas.

In an alternative further preferred embodiment, the connection for carrying the crankcase gases in the oil filler tube has a annular opening. In this case, the pressure control valve is provided with a tubular projection which has holes in the area of the annular opening which produce the connection for the crankcase gases when the cap is closed.

In a further preferred embodiment of the invention the connection provided in the oil filler tube or in the tubular projection of the pressure control valve has an end face configured as a valve seat. A diaphragm valve body is disposed opposite the valve seat and closes or opens the valve depending on the pressure conditions.

A further preferred embodiment of the invention is particularly advantageous where the blow-by gases have to be fed directly into the intake manifold of the engine. As is known, a very high vacuum prevails in the intake manifold during idling and under load. This high vacuum would prevent the valve from opening, thereby causing a rise in pressure in the crankcase.

In accordance with a further preferred embodiment of the invention a double-action valve is used, such as the valve described, for example, in Holch, Published German Patent Application No. DE 4,022,129. This valve has the advantage that two valve systems for different pressure conditions are combined in one housing, only a single membrane being necessary for both valve systems. Nevertheless, a simple, easy-to-assemble construction of the entire pressure control valve is achieved.

The parts of the pressure control valve are made, for example, by injection molding from plastic. It is thus possible to produce such valves economically in large quantities. Only the diaphragm valve body is made from a rubber material.

BRIEF DESCRIPTION OF THE DRAWING

The invention will be explained in further detail hereinafter with reference to illustrative preferred embodiments shown in the accompanying drawings, in which.

DETAILED DESCRIPTION OF PREFERRED EMBODIMENTS

Figure 1:
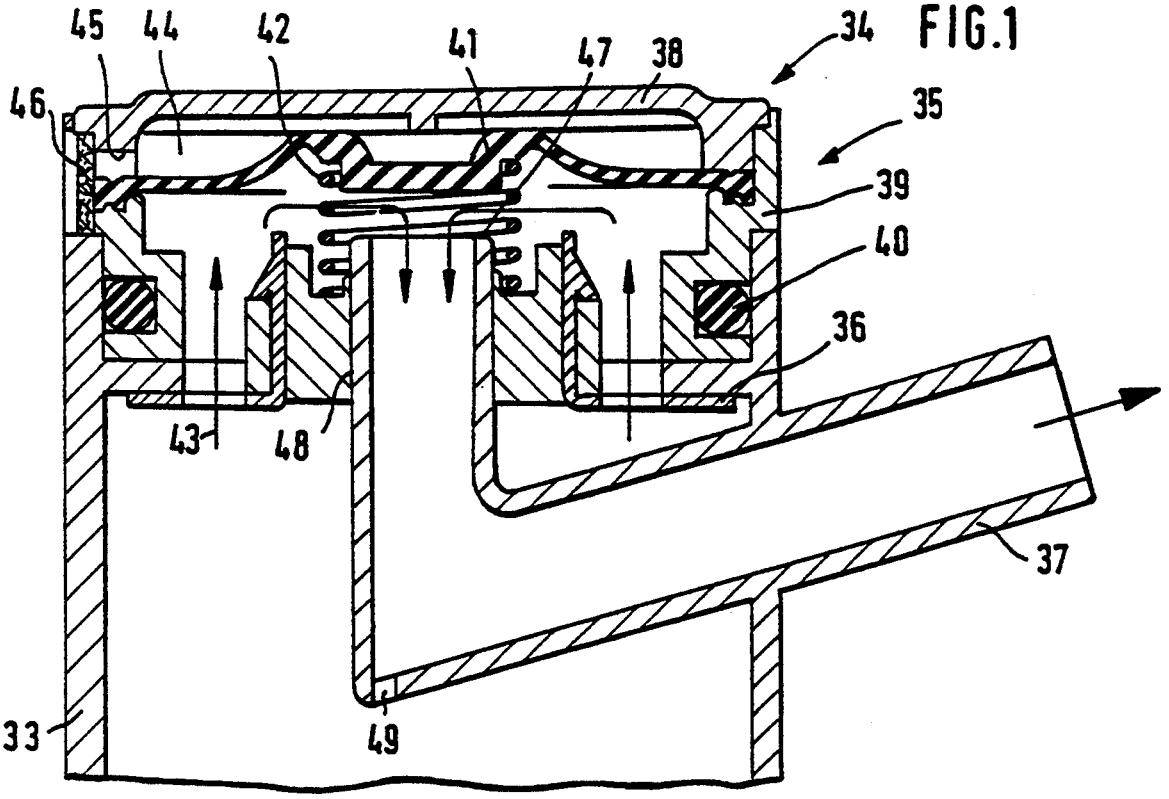
FIG. 1 shows a pressure control valve on the oil filler tube of an engine.

FIG. 1 shows diagrammatically an oil filler opening 33 on which a cap formed by the housing 34 of the pressure control valve 35 is mounted by a bayonet lock 36. A bent tube 37 leads outward from the oil filler opening. A tube can be fastened to or connecting line its mouth and connected to the air intake of the internal combustion engine, i.e. to the intake manifold or the air filter housing. The pressure control valve 35 comprises a cover part 38, a bottom part 39, an O-ring 40 and a diaphragm valve body 41. The diaphragm valve body is held in an open position by a spring 42. In this state the blow-by gases, which enter the pressure control valve 35 in the direction of the arrow 43, can pass unhindered into the tube 37 and from there into the air intake. The diaphragm valve body 41 is clamped between the cover part and the bottom part of the housing and seals off an upper valve or vent chamber 44. This vent chamber, however, is open to the outside atmosphere through a bore 45, so that the ambient pressure prevails in vent chamber 44. The bore 45 is desirably covered with a small filter pad 46. As soon as the vacuum rises in tube 37, the diaphragm valve body 41 moves against the spring force into engagement with a valve seat 47 formed at the inner end of the tube 37 and thereby preventing gas from flowing through tube 37. The spring 42 and the valve areas are dimensioned so that a low vacuum always prevails in the crankcase. The O-ring 40 provides for an effective sealing of the oil filler opening. The bottom part 39 of the pressure control valve is provided with a bore 48 which is slightly larger than the upwardly pointing part of tube 37, and the upwardly pointing part of tube 37 projects through bore 48 into the valve when housing 34 is positioned to close oil filler opening 33.

To add motor oil, the pressure control valve 35 is removed, whereby tube 37 pulls out of housing bottom part 39. If small amounts of motor oil get into the tube 37, it will flow down through a bore 49.

Figure 2:
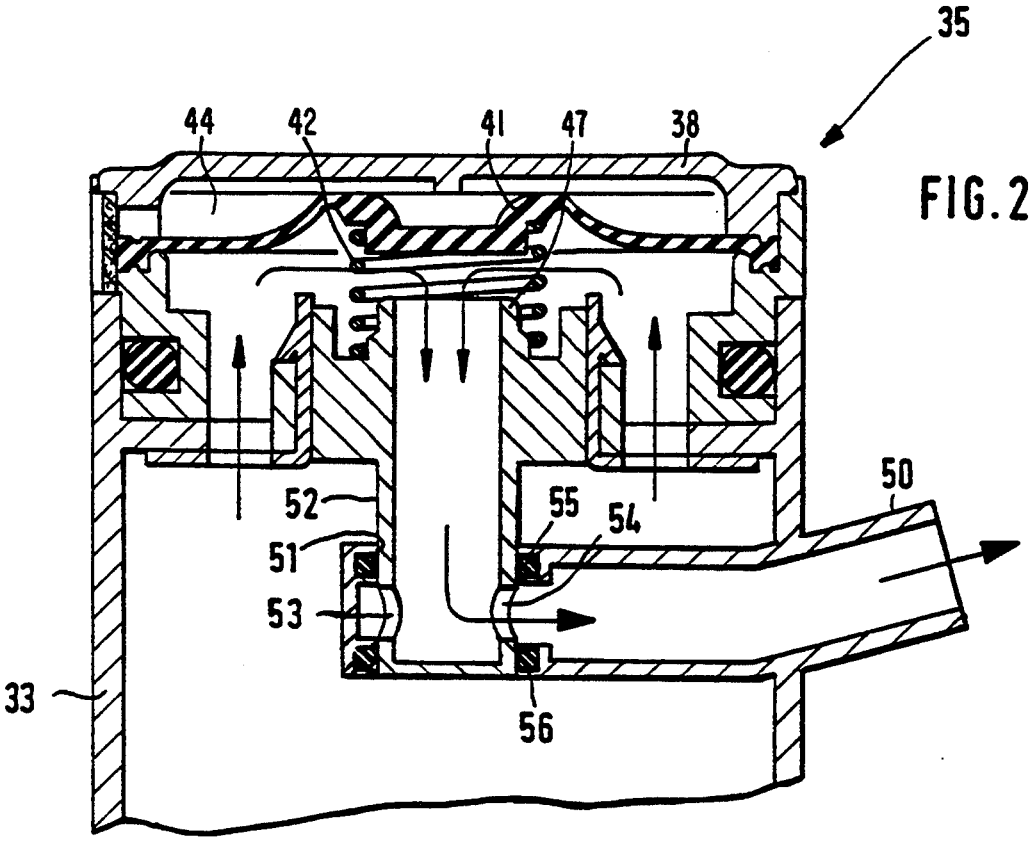
FIG. 2 shows a variant of the pressure control valve depicted in FIG. 1.

A variant embodiment shown in FIG. 2 comprises a pressure control valve constructed in the same manner as the valve of FIG. 1 with a diaphragm valve body 41, a spring 42 and a valve seat 47. However, in the embodiment of FIG. 2, the tube which is connected to the air intake of the internal combustion engine is constructed in two parts. As shown in FIG. 2, tube 50 has a circular opening 51 at its inside end, and the pressure control valve 35 is equipped with a tubular projection 52, which is closed at its bottom end and is provided with lateral outlet bores or openings 53 and 54. If the pressure control valve 35 is placed on the oil filler opening 33, the tubular projection 52 extends into the tube 50 and thus establishes the connection for the blow-by gases. O-rings 55 and 56 are provided for sealing projection 52 to tube 50. When the cap is removed from oil filler opening 33, projection 52 pulls out of tube 50.

Figure 3:
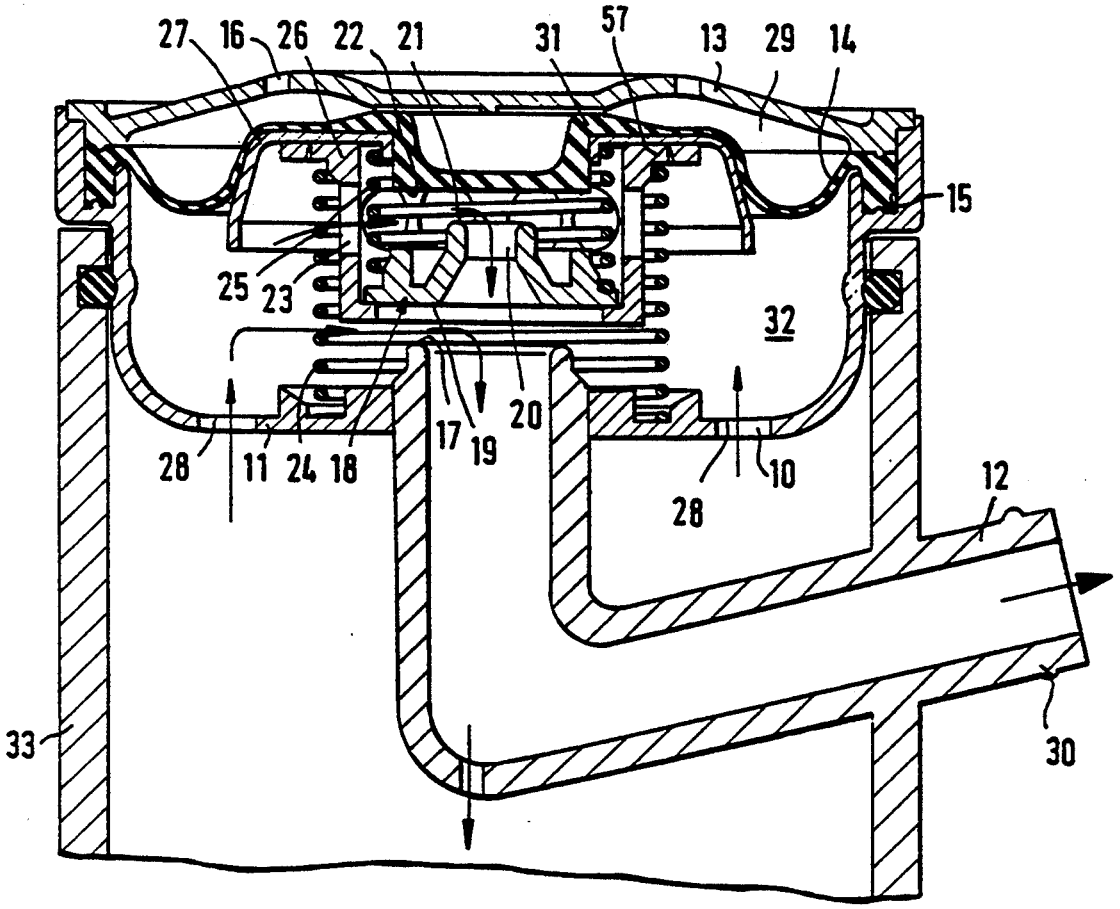
FIG. 3 shows a pressure control valve for high intake manifold vacuums.

A pressure control valve which is able to compensate even high intake manifold vacuums is shown in FIG. 3. It comprises a valve housing 11 having at least one air inlet opening 28 which constitutes a first connection through which crankcase gases enter the valve. This intake opening is inside of the oil filler opening 33.

The valve housing 11 forms a cap for the oil filler opening and is open at the top and contains at its top opening an annular groove 15. A housing cover 13 is fastened over the open top of the valve housing 11, and a diaphragm 14 is disposed between the housing cover 13 and valve housing 11. The central area of this diaphragm or membrane is thickened and has in this area a surface 22 which functions as a valve plate facing the valve housing.

Between the diaphragm 14 and the housing cover 13 a first valve chamber 29 is formed, which communicates with the external atmospheric pressure through a vent hole 16. The valve housing 11 is disposed above an outlet connection 12. This outlet connection 12, which constitutes a second connection which communicates via a connecting line to the air intake of the internal combustion engine is provided with an annular bead 30 for connecting a tube leading to the air intake of the engine. When the cap formed by housing 11 is removed form the oil filler opening 32, outlet connection 12 which is attached to oil filler opening 33 pulls out of housing 11.

The central area of the diaphragm 14 is supported by a supporting body 27 which protects the diaphragm from the parts which act against the membrane. A hollow cylindrical part 26 is placed against this supporting body 27, and can either be affixed to the supporting body or it can be a separate piece.

A compression spring 24 lies against an annular collar 57 of the hollow cylindrical part 26. This compression spring 24 is supported at its opposite end against the valve housing bottom 11. Compression spring 24 urges the diaphragm 14 toward an upper end position where a thickened portion 31 of the diaphragm contacts the housing cover 13.

An intermediate valve member 18 is provided inside the hollow cylindrical part 26. This intermediate valve member 18 is provided with a valve plate 19 facing valve seat 17 and with a valve seat 21 facing valve plate 22. Also, the intermediate valve member 18 has a valve opening 20 of predetermined diameter which is smaller than the diameter of the valve seat 17. In the state of rest, the intermediate valve 18 member is held by a compression spring 25 in the illustrated position in which valve plate 22 is spaced from valve seat 21. By means of this intermediate valve member, two differently acting valves are formed in the pressure control valve, one valve comprising valve plate 19 and valve seat 17 and one valve comprising valve plate 22 and valve seat 21. The hollow cylindrical part 26 is provided with openings 23 in its sides.

In the position shown in FIG. 3, the blow-by gases, which arise in the crankcase of the engine, pass up through oil filler tube 33 and enter valve 35 through the inlet openings 28. The gases then are discharged through the outlet connection 12 while both valves are open. This valve position obtains whenever the intake manifold vacuum is very low or virtually no intake manifold vacuum exists. In this position the greatest possible throughput of blow-by gases can be achieved even under low intake manifold vacuum.

A more complete explanation of the operation of the valve is found in Holch, Published German Patent Application No. DE 4,022,129, which is incorporated herein by reference.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An oil filler for an internal combustion engine having an air intake and a crankcase, said oil filler comprising a filler opening for motor oil and a detachable cap for closing said opening, said oil filler defining an interior space in communication with said crankcase, and said cap (comprising) having a pressure control valve integrated therein for venting the crankcase of said internal combustion engine, said pressure control valve having a substantially cylindrically shaped housing and being provided with a first connection through which crankcase gases from the crankcase enter the valve, said first connection comprising an opening through said housing arranged to open directly into the interior space defined by said oil filler, and a second connection which communicates via a connecting line to the air intake of the internal combustion engine, said connecting line being fixedly mounted on said oil filler opening and separating from said cap when said cap is removed from said oil filler opening.

2. An oil filler according to claim 1, wherein said first connection is disposed in the oil filter opening and has a crankcase opening coaxial to the oil filler opening, said crankcase gas opening communicating with said pressure control valve.

3. An oil filler for an internal combustion engine having an air intake and a crankcase, said oil filler comprising a filler opening for motor oil and a cap for closing said opening, said cap comprising a pressure control valve having a substantially cylindrically shaped housing for venting the crankcase of said internal combustion engine, said pressure control valve being provided with a first connection through which crankcase cases from the crankcase enter the valve, and a second connection which communicates via a connecting line to the air intake of the internal combustion engine, wherein said second connection is provided with an opening coaxial with said oil filler opening and said pressure control valve comprises a tubular projection having a first end which is matingly received in said coaxial opening when said oil filler opening is closed by said cap, thereby forming a connection between said pressure control valve and said second connection for carrying crankcase gases from said pressure control valve to said air intake.

4. An oil filler according to claim 3, wherein a second end of said tubular projection forms a valve seat, and a diaphragm valve body is provided in said oil filler cap opposite said valve seat, said diaphragm valve body closing said second end of said tubular projection to interrupt the connection between said pressure control valve and said air intake when a predetermined pressure is reached in said crankcase.

5. A pressure control valve comprising a housing comprising a housing cover and a housing bottom, an outlet connection having an end opening inside said housing configured as a first valve seat, a diaphragm valve body carrying a first valve plate and having an outer margin sealingly clamped in a groove between said housing cover and said housing bottom, said diaphragm valve body dividing said valve housing into a valve chamber and a vent chamber connected to the atmosphere by a vent passage, a compression spring resting against said housing bottom and urging said diaphragm towards said housing cover, an intermediate valve member disposed between the valve plate on the diaphragm and said first valve seat, said intermediate valve member carrying a second valve seat which faces said valve plate on the diaphragm valve body and a second valve plate facing said valve seat, said intermediate valve member being carried on said diaphragm such that an axial relative movement is possible between the valve plate on said diaphragm and the intermediate valve member, and said housing forming a detachable cap for an oil filler opening of an internal combustion engine, said outlet connection being fixedly attached to said oil filler opening and separating from said housing when said cap formed by said housing is detached from said oil filler opening.

6. A pressure control valve according to claim 5, further comprising a second compression spring between said intermediate valve member and said diaphragm valve body for urging said first valve plate away from said second valve seat on said intermediate valve member.

* * * * *